US009962968B2

(12) United States Patent
Yano

(10) Patent No.: US 9,962,968 B2
(45) Date of Patent: May 8, 2018

(54) SHEET FEEDING APPARATUS

(75) Inventor: Yukiteru Yano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 977 days.

(21) Appl. No.: 13/186,243

(22) Filed: Jul. 19, 2011

(65) Prior Publication Data

US 2012/0018484 A1 Jan. 26, 2012

(30) Foreign Application Priority Data

Jul. 22, 2010 (JP) ..... 2010-164912

(51) Int. Cl.
*B41J 11/70* (2006.01)
*B41J 15/04* (2006.01)
(Continued)

(52) U.S. Cl.
CPC ..... *B41J 15/044* (2013.01); *B41J 11/70* (2013.01); *B41J 15/042* (2013.01); *B41J 15/06* (2013.01); *B65H 16/02* (2013.01); *B65H 20/02* (2013.01); *G03G 15/6502* (2013.01); *G03G 15/6523* (2013.01); *Y10T 83/4491* (2015.04);
(Continued)

(58) Field of Classification Search
CPC ..... B41J 15/042; B41J 15/044; B41J 11/70; B41J 11/703; B41J 11/706; B41J 15/02; B41J 15/04; B41J 15/06; B65H 20/02; B65H 16/02; G03G 15/6502; G03G 15/6517; G03G 15/652; G03G 15/6523; Y10T 83/4491; Y10T 83/4625; Y10T 83/535; Y10T 83/626; Y10T 83/637; Y10T 83/6635; Y10T 83/6644; Y10T 83/896
USPC ..... 83/649, 221, 274, 366, 399, 400, 436.1, 83/436.5; 400/629
See application file for complete search history.

(56) References Cited

U.S. PATENT DOCUMENTS 334,663 A * 1/1886 Hinkley George M ..... B26D 7/018 83/422
3,379,081 A * 4/1968 Firth et al. ..... A41H 43/005 83/422
(Continued)

FOREIGN PATENT DOCUMENTS

CN 101234712 A 8/2008
CN 101376466 A 3/2009
(Continued)

*Primary Examiner* — Clark F Dexter
(74) *Attorney, Agent, or Firm* — Canon U.S.A., Inc. IP Division

(57) ABSTRACT

The present invention provides an inexpensive and compact printing apparatus. The printing apparatus includes a sheet feeding mechanism configured to convey a sheet in an orthogonal direction to a loading direction of a cassette, and moves between a press-contacting position and a retraction position, an urging member configured to urge the cassette in a drawing-out direction, a locking member configured to abut against the cassette at a locking position opposed to the urging member, to regulate a movement of the cassette, and to enable draw-out of the cassette at a release position, and an interlocking member configured to regulate the movement of the locking member when the sheet feeding mechanism is located at the press-contacting position, and to release the regulation of the movement of the locking member when the sheet feeding mechanism is located at the retraction position.

8 Claims, 12 Drawing Sheets

(51) Int. Cl.

| | |
|---|---|
| ***B41J 15/06*** | (2006.01) |
| ***B65H 16/02*** | (2006.01) |
| ***B65H 20/02*** | (2006.01) |
| ***G03G 15/00*** | (2006.01) |

(52) U.S. Cl.
CPC ..... *Y10T 83/626* (2015.04); *Y10T 83/6635* (2015.04); *Y10T 83/6644* (2015.04); *Y10T 83/896* (2015.04)

(56) References Cited

U.S. PATENT DOCUMENTS

| | | | | |
|---|---|---|---|---|
| 3,443,462 | A * | 5/1969 | Doohan | B65H 35/08 226/175 |
| 6,128,989 | A * | 10/2000 | Jones et al. | B23D 47/005 144/247 |
| 6,994,483 | B2 * | 2/2006 | Jang | 400/629 |
| 7,733,361 | B2 * | 6/2010 | Choi et al. | 347/171 |
| 8,272,795 | B2 * | 9/2012 | Tanabe et al. | 400/208.1 |
| 2011/0140355 | A1 * | 6/2011 | Nishikata et al. | 271/264 |

FOREIGN PATENT DOCUMENTS

| | | | |
|---|---|---|---|
| JP | 05-051137 | A | 3/1993 |
| JP | 05-51137 | A | 3/1993 |
| JP | 06-263271 | A | 9/1994 |
| JP | 06-263271 | A | 9/1994 |
| JP | 10-250161 | A | 9/1998 |
| JP | 2002-128289 | A | 5/2002 |

* cited by examiner

SHEET FEEDING APPARATUS

BACKGROUND OF THE INVENTION

Field of the Invention

The present invention relates to a sheet feeding apparatus capable of mounting a sheet cassette in which paper sheets are stored.

Description of the Related Art

In a conventional printing apparatus such as a printer in which a paper sheet is fed from a sheet cassette storing sheets therein, the sheet is coated with ink, and thermal transfer is performed, various failures will occur if a draw-out of the sheet cassette is performed due to an erroneous operation or the like during operation after sheet feeding.

For example, when a sheet sandwiched by rollers is forcibly pulled out, there may occur troubles such as occurrence of jamming or breakage of the sheet. In particular, in a roll paper printer such as the one in which a roll-shaped sheet is pulled out and cut after performing photographic printing, the sheet remaining in the sheet cassette and a portion where the photographic printing process is being performed are connected with each other, even after the sheet feeding.

For this reason, if an attempt of forcibly drawing out the sheet cassette is made, the sheet is likely to be damaged, in most cases. In particular, in a printing apparatus such as the one in which a conveyance direction of the sheet and a loading direction of the sheet cassette intersect at right angles to each other, even a little positional deviation or inclination of the cassette exerts significant influence on a head at a conveyance destination of the sheet, and a conveyance path.

For example, even a small inclination at a sheet cassette unit causes positional deviations to be enlarged in a direction orthogonal to the conveyance path of the sheet, at a print head and at the conveyance path after the head, and the longer the distance is, the more significant the influence becomes. For this reason, the sheet is conveyed being greatly skewed to the print head. As a result, photographic print quality is deteriorated remarkably, and the sheet heavily bumps against a side surface of the conveyance path, thereby causing a serious jamming.

Reflecting on these problems, various mechanisms are discussed for locking the draw-out of the sheet cassette in order to prevent the sheet from being drawn out during the photographic printing or after the sheet feeding.

For example, in a printer such as the one in which photographic printing is performed while a print head and a platen are pressure contacted with each other, there is the one which includes an engagement member with the cassette so as to be integral with or to interlock with a driving side of either the print head or the platen. Generally there is employed a method such as the one in which the engagement member is engaged with the sheet cassette so that the sheet cassette is locked while the print head is pressure contacted therewith.

Further, in Japanese Patent Application Laid-Open No. 05-051137, a rotation of a motor is transmitted to a sheet feeding unit by a rotating body at the time of the sheet feeding, and a latching body is moved in an opposite direction to an urging direction of an urging member which urges the latching body by a rotational force of the rotating body at this time, and thereby the latching body is latched with a locking portion provided in a sheet cassette.

This prohibits dismounting of the sheet cassette during the sheet feeding, and prevents occurrence of the jam. Then, at the time of a non-sheet feeding when the rotating body is stopped, mounting and dismounting operations of the sheet cassette with respect to the printing apparatus main body is permitted by causing the latching body to be retracted from the latching portion by the urging force of the urging member.

In Japanese Patent Application Laid-Open No. 06-263271, in a cassette locking mechanism of a push-push type, a stopper for preventing pushing-in of the sheet cassette is provided at a portion of a lifting mechanism which lifts up a leading edge of a recording sheet stored in the sheet cassette to bring it into pressure contact with the sheet feed roller. Countermeasure is taken by causing the stopper to inhibit the pushing-in of the sheet cassette when the lifting mechanism is located at an insertion position, and to permit the pushing-in of the sheet cassette when the lifting mechanism is located at a retraction position.

Further, there is a method for energizing a solenoid and locking the movement of the cassette at a timing when one does not want to draw out the sheet cassette, and keeping it retracted at other times. In addition, there is another method for preventing the draw-out of the sheet cassette by using a dedicated actuator.

However, in the above-described locking mechanism, which is interlocked with an operation of the head or the platen during operation period of time other than when the head and the platen are pressure contacted with each other, if an attempt is made to draw out the cassette, the cassette is not locked. Therefore, the cassette can be moved in a direction in which the cassette can be drawn out.

Then, even during operation period of time other than when the head and the platen are pressure contacted with each other, the sheet is sandwiched between certain rollers. Then, when the cassette must not be drawn out, for example, when a portion of the sheet remains in the cassette, failures as described above may occur.

On the other hand, in Japanese Patent Application Laid-Open No. 05-051137, a latching body for preventing the draw-out of the cassette is directly engaged with the cassette to perform locking. In this case, the locking operation for preventing the draw-out directly acts on the cassette. For this reason, a position of the cassette may be influenced thereby, though it may be small.

Further, in Japanese Patent Application Laid-Open No. 6-263271, the stopper provided in the lifting mechanism of the sheet prevents the pushing-in of the sheet cassette. With this method, if a relationship between the stopper and the sheet cassette is set so that there is absolutely no pushing-in amount, the stopper abuts against the sheet cassette, and thereby the position of the cassette is influenced, though it may be small.

Further, a positional relationship between the stopper and the sheet cassette is set so as to permit the pushing-in to a degree that the lock is not disconnected. In this case, if the user pushes in the sheet cassette by an erroneous operation, a movement of the cassette position will be tolerated, though it may be small. As a result, the photographic printing operation may be influenced thereby.

Therefore, as discussed in Japanese Patent Application Laid-Open No. 06-263271, if a conveyance direction of the sheet and a loading direction of the sheet cassette coincide with each other, the influence is not so serious. On the contrary, if the loading direction of the sheet cassette and the conveyance direction of the sheet intersect at right angle to each other as described above, the influence may be serious.

If a position of the cassette is shifted even though it is small, by the operation that the user has tried to draw out the cassette in this way, a failure such as jamming, positional deviation, or skew may occur, depending on a configuration of the apparatus. As a result, the quality deteriorations of various photographic printing products may occur.

Further, as with a method lastly described, if an actuator is provided for dedicated use, only for preventing the draw-out of the sheet cassette during photographic printing, it may cause an increase in cost and increase in size of the printing apparatus main body.

SUMMARY OF THE INVENTION

The present invention is directed to a sheet feeding apparatus and a printing apparatus capable of assuring safe and appropriate operation, which is inexpensive and compact.

According to an aspect of the present invention, a sheet feeding apparatus on which a cassette for storing a paper sheet is mounted includes a sheet feeding mechanism configured to convey the paper sheet in an orthogonal direction to a loading direction of the cassette, and move between a press-contacting position and a retraction position, a locking member configured to abut against the cassette at a locking position, regulate a movement of the cassette, and enable draw-out of the cassette at a release position, and an interlocking member configured to regulate a movement of the locking member when the sheet feeding mechanism is located at the press-contacting position, and release a regulation of a movement of the locking member when the sheet feeding mechanism is located at the retraction position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
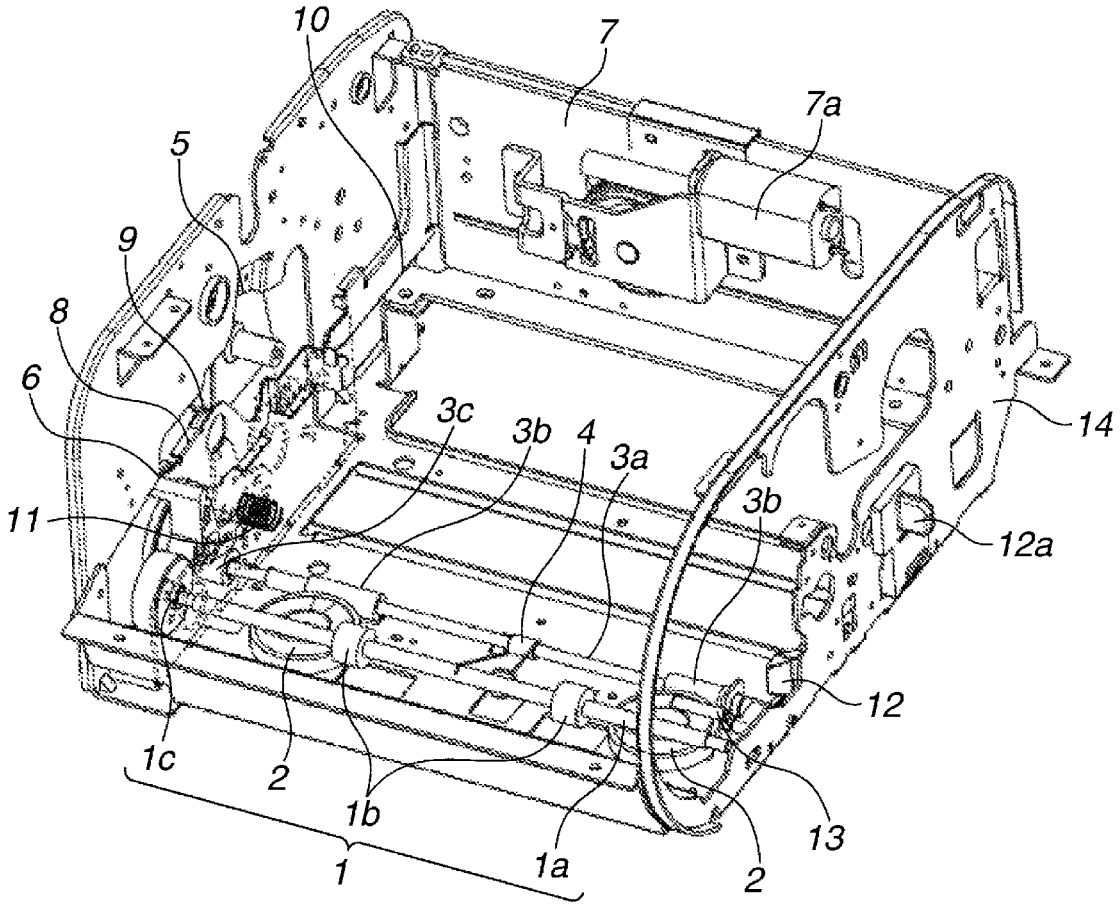
FIG. 1 is a perspective view of the front side of a printing apparatus illustrating principal components thereof according to an exemplary embodiment of the present invention.

Various exemplary embodiments, features, and aspects of the invention will be described in detail below with reference to the drawings.

Throughout the drawings, the same reference numerals indicate the same or corresponding portions.

First, outlines of the components described in the claims will be described, with reference to the drawings according to an exemplary embodiment of the present invention. FIG. 1 is a perspective view of the front side of the interior of a printing apparatus illustrating a configuration of the principal components according to an exemplary embodiment of the present invention.

In FIG. 1, a sheet feeding mechanism includes a sheet feed roller 1 and cam gears 2, the sheet feed roller 1 serves as a conveyance unit 1, and the cam gears 2 each serve as a movement unit 2 thereof. The sheet feed roller 1 includes a shaft portion 1*a* and a rubber portion 1*b*, and is unitized with a gear 1*c* that is press-fitted into the end of one side. The gear 1*c* can drive and rotate the sheet feed roller 1 in a sheet feeding direction and an accommodating direction, by being constantly coupled to a gear array described below.

A gear shaft unit 3 serves as a driving member that can transmit a rotational driving force to the cam gears 2. A torsion spring 4 elastically urges the sheet feed roller 1. The gear shaft unit 3 is integrally configured by two worm gears 3*b* and a gear 3*c* which are pressure-fitted into the shaft portion 3*a* in a piercing-through-skewer fashion. Further, the torsion spring 4 is rotatably supported by the shaft portion 3*a*, and urges the sheet feed roller 1 in substantially downward direction in FIG. 1.

A sheet feed motor 5 serves as a common driving source 5 for driving the conveyance unit 1 and the movement unit 2. A planet unit 6 serves as a coupling unit 6 for coupling a transmission unit from the sheet feed motor 5 to the gear shaft unit 3, and has a coupling position and a non-coupling position from the sheet feed motor 5 to the cam gears 2. In the present exemplary embodiment, a stepping motor 5 is used as the sheet feed motor 5, but if a control of rotation amount by using an encoder or the like is possible, it is not limited to the stepping motor.

A cutter unit 7 serves as a cutting unit of the sheet, and a cutter motor 7*a* serves as a driving source 7*a* of the cutter unit 7. In the present exemplary embodiment, the scissor-shaped cutter unit 7 of which a blade 7*c* moves in a vertical direction (up and down) relative to a surface of the sheet is exemplified as the cutting unit 7 of the sheet.

As an additional cutting unit of the sheet, a rotary cutter (not shown) or the like which reciprocates in a width direction (lateral direction) of the sheet is also known, and the present invention is not intended to limit a type of the cutting unit of the sheet.

A regulating lever 8 serves as a regulation unit 8, and a torsion spring 9 urges the regulating lever 8 in a substantially downward direction (regulating direction) in FIG. 1. An interlocking lever 10 is fixed to the movable cutter blade 7*c* as will be described below referring to FIG. 2A, and is integrally configured with the movable cutter blade 7*c*.

A coil spring 11 serves as a cassette urging member 11, which urges the sheet cassette 18 in a drawing-out direction. A locking member 12 is used to regulate a movement of the loaded sheet cassette 18 to fix a position of the cassette 18. The sheet cassette 18, when loaded, is urged in the drawing-out direction by the coil spring 11, and the locking member 12 is engaged with the sheet cassette 18 on a side of a loading opening, and thereby a position of the cassette 18 is determined while being shifted to one side.

The draw-out of the sheet cassette 18 is possible at a release position of the movement/regulation by the locking member 12. Further, an interlocking member 13 is an interlocking member with the sheet feeding mechanism 12 to regulate a movement of the locking member 12, interlocking with an operation of the sheet feed roller 1. A frame member 14 is a frame of a main body of the printing apparatus.

Figure 2A:
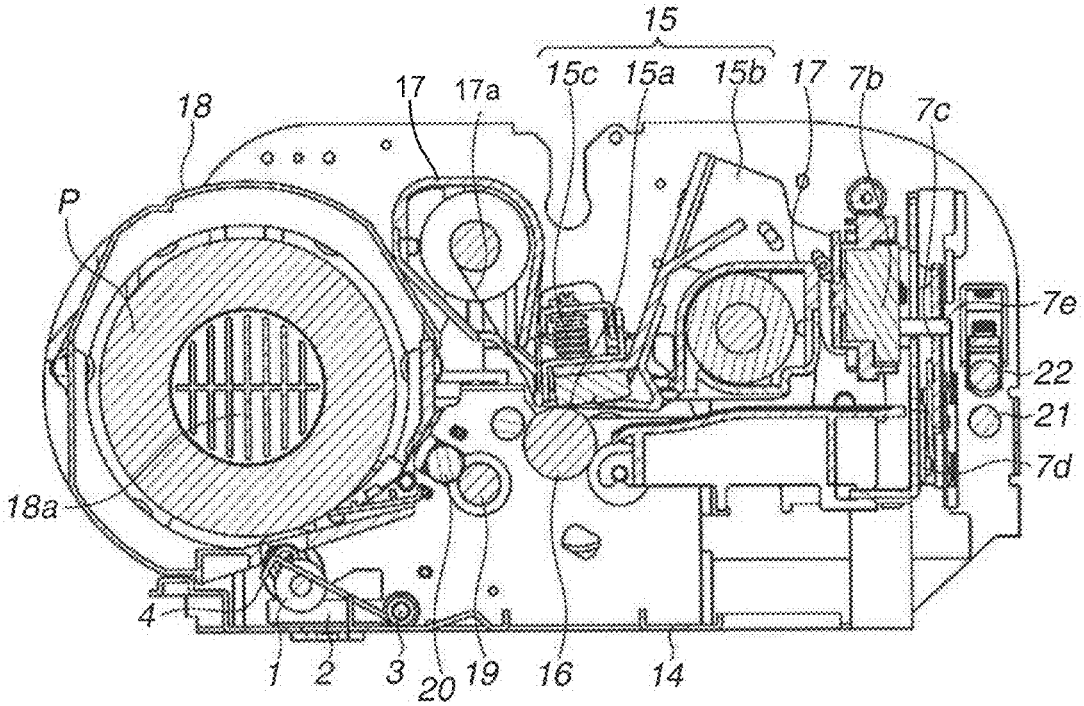
FIG. 2A is a cross-sectional view illustrating a schematic configuration of the printing apparatus according to the exemplary embodiment the present invention.
Figure 2B:
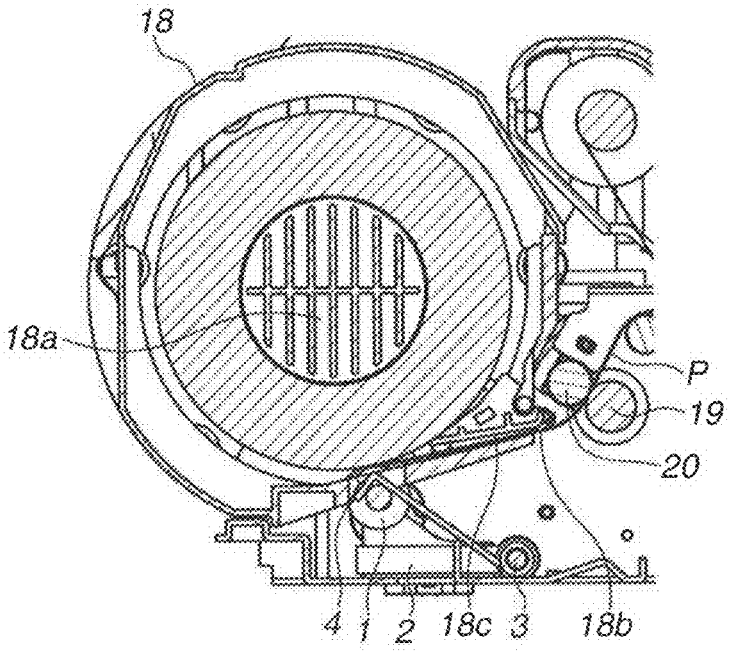
FIG. 2B is a cross-sectional view illustrating a schematic configuration of a sheet feeding unit of the printing apparatus according to the exemplary embodiment of the present invention.

FIG. 2A is a cross-sectional view illustrating a schematic configuration of the printing apparatus according to the exemplary embodiment of the present invention. FIG. 2B is an enlarged cross-sectional view of a portion of a schematic configuration of the printing apparatus. FIG. 2A illustrates a standby state in which the cassette 18 can be mounted and dismounted, whereas FIG. 2B illustrates a conveyance state in which the sheet can be conveyed.

A roll paper P serves as a recorded material, and a thermal head 15 serves as a photographic printing unit 15. A platen roller 16 is arranged so as to be opposed to the thermal head 15, and to sandwich a conveyance path of the roll paper P therebetween. An ink ribbon 17*a* is wound around a supply bobbin within a supply roll accommodating unit of an ink ribbon cassette 17 and around a take-up bobbin within a take-up roll accommodating unit. The ink ribbon 17*a* covers a photographic printing region of the roll paper P, and the size of the ink ribbon 17*a* is slightly larger than the size of a covered photographic printing region. Further, a printer in which respective ink layers for yellow (Y), magenta (M), cyan (C) and an overcoat (OC) layer are provided side by side for each frame, is general in color printers.

The thermal head 15 is provided with a heating portion 15*a* having a plurality of heating elements, selectively heats the heating elements according to image formation information, and thermally transfers an ink uniformly coated on the ink ribbon 17*a* onto the roll paper P. The thermal head 15 is substantially integrally configured with a mounting frame 15*b* provided with a center of rotation and a spring member 15*c*, and is swingable by controlling a cam gear (not illustrated).

At the time of photographic printing operation, the mounting frame 15*b* is turned to a predetermined position, and presses the heating portion 15*a* and the platen roller 16. In this manner, the ink ribbon 17*a* and the roll paper P are brought into pressure contact with each other under an appropriate pressure by an elastic force of the spring member 15*c*, thereby carrying out thermal transfer.

The roll paper cassette 18 holds the roll paper P therein in a state where continuous belt-like roll paper P is wound around a roller-shaped bobbin 18*a*. The roll paper P is available in a plurality of sizes such as a card size, an L size, a post card size, and each of them is accommodated in a dedicated or a common-use roll paper cassette 18. When a photographic printing operation is performed, the ink ribbon cassette 17 and the roll paper cassette 18 adapted to any size are inserted into the apparatus main body before the photographic printing.

Figure 5:
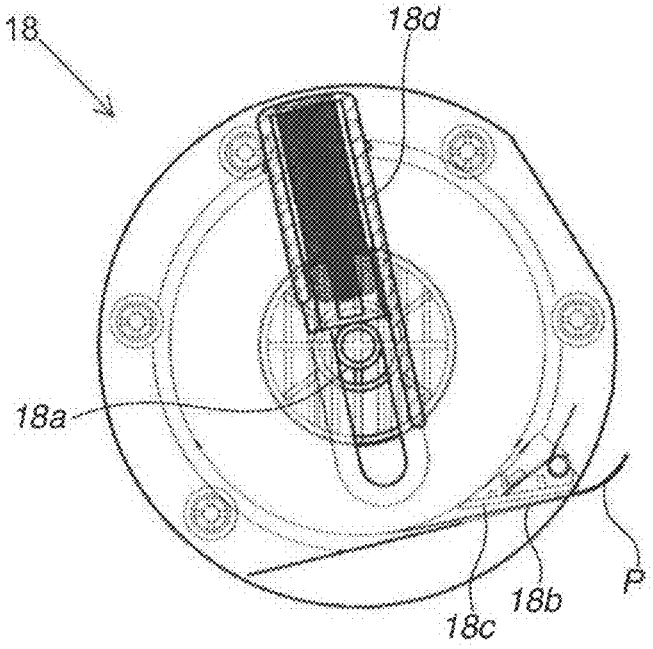
FIG. 5 is a cross-sectional view illustrating a schematic configuration of a roll paper cassette according to the exemplary embodiment of the present invention.

In the roll paper cassette 18, as illustrated in FIG. 5, a slit-like roll paper exit 18*b* is provided on a portion of an outer circumferential surface, so that the roll paper P can be pulled out from within the roll paper cassette 18. A separating member 18*c* picks up the leading edge of the roll paper P, and guides it toward the roll paper exit 18*b*.

As illustrated in FIG. 2A, in the standby state in which the loading and draw-out of the roll paper cassette 18 are possible and each operation is stopped, the sheet feed roller 1 is spaced apart from the roll paper P held within the roll paper cassette 18.

On the other hand, as illustrated in FIG. 2B, in a conveyance state in which conveyance of the roll paper P is possible, and sheet feeding and accommodation of the sheets are possible, the sheet feed roller 1 is located at a position at which the sheet feed roller 1 comes into pressure contact with the roll paper P held within the roll paper cassette 18.

At this time, the bobbin 18*a* is disposed so as to be opposed to the sheet feed roller 1 so as to sandwich the roll paper P therebetween, and is further urged in a pressing direction against the sheet feed roller 1, by a spring member 18*d* (FIG. 5) described below. For this reason, the roll paper P held by the bobbin 18*a* receives an urging force of the spring member 18*d* via the bobbin 18*a*, and has come into pressure contact with the sheet feed roller 1.

A capstan roller 19 is a metallic drive roller for primarily conveying a sheet after the sheet feeding operation. Further, a pinch roller 20 serving as a driven roller is elastically urged in a normal direction (diameter direction) of a shaft portion of the capstan roller 19 by a spring member (not illustrated).

Generally in the thermal transfer type printing apparatus, a thorn-shaped protrusion (not illustrated), which can be pierced into a back surface of the roll paper P to a depth enough not to cause phase deviation, is formed on a portion of the shaft portion of the capstan roller 19. Thereby, deviation due to slide or deformation of the roller 19 is hard to occur, and even when reciprocal conveyance is performed a plurality of times, the roll paper P can be stably conveyed.

A cam gear 7*b* is coupled with the cutter motor 7*a*. The movable cutter blade 7*c* interlocks with the cam gear 7*b*. A fixed cutter blade 7*d* is arranged so as to be opposed to the movable cutter blade 7*c* so as to sandwich the conveyance path of the roll paper P therebetween. For the printing apparatus using the roll paper P, there are required the movable cutter blade 7*c* and the fixed cutter blade 7*d*, which are, for example, made of metal and a part thereof is sharply processed in order to cut the roll paper P into arbitrary lengths.

A pin 7*e* is pressure-fitted into the cam gear 7*b* driven and rotated by the cutter motor 7*a*. The movable cutter blade 7*c* engaged with the pin 7*e*, as the pin 7*e* is displaced in a vertical direction (up and down) relative to a surface of the sheet, along with rotation of the cam gear 7*b*, performs reciprocal motion in the same direction. At this time, the movable cutter blade 7*c* and the fixed cutter blade 7*d* cut the roll paper P by sliding relative to each other in a scissor-like fashion.

A sheet discharge roller 21 and a sheet discharge pinch roller 22 are arranged so as to be opposed to each other at a substantially lower surface and a substantially upper surface, respectively, so as to sandwich the conveyance path of the roll paper P therebetween. If the roll paper P has slack or an up-and-down movement during a cutting action, there occur failures such as variation of lengths of the cut sheets, and degradation of quality of cut faces.

In the present exemplary embodiment, a roller pair consisting of the sheet discharge roller 21 and the sheet discharge pinch roller 22 not only discharges the cut sheets, but also exerts an arbitrary tension to the roll paper P, thereby suppressing the slack and the up-and-down movement.

More specifically, in order to exert arbitrary tension to the roll paper P, a conveyance speed of the roll paper P by the sheet discharge roller 21 is made faster than a conveyance speed of the roll paper P by the capstan roller 19. Furthermore, a nip pressure of the roller pair consisting of the sheet discharge roller 21 and the sheet discharge pinch roller 22 is set weaker than a nip pressure of the roller pair consisting of the capstan roller 19 and the pinch roller 20.

With these configurations, the sheet discharge roller 21 slips on the surface of the roll paper P, and arbitrary tension can be applied to the roll paper P between the capstan roller 19 and the sheet discharge roller 21.

Figure 3A:
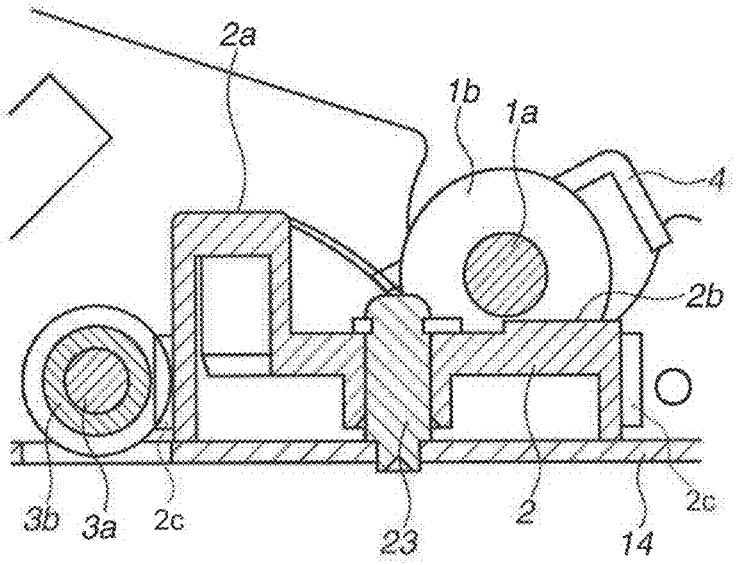
FIG. 3A is a cross-sectional view of a sheet feed roller elevation device in a standby state according to the exemplary embodiment of the present invention.
Figure 3B:
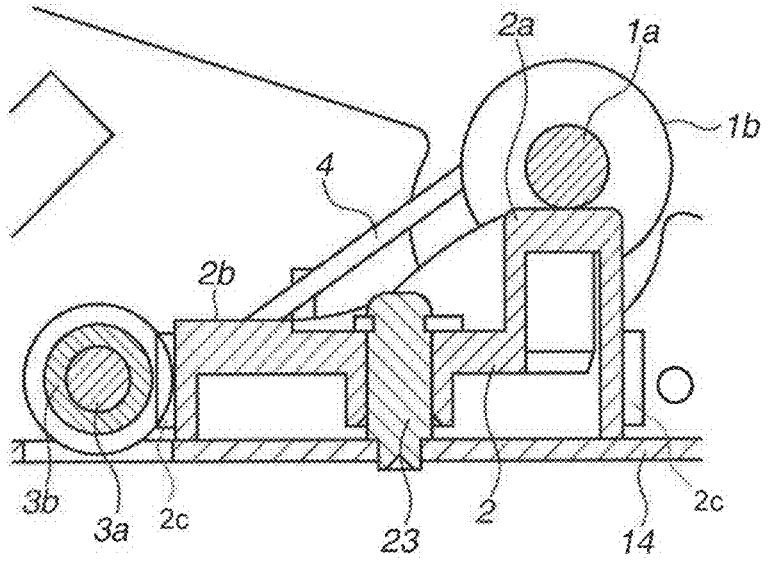
FIG. 3B is a cross-sectional view of the sheet feed roller elevation device in a conveyance state according to the exemplary embodiment of the present invention.

FIG. 3A is an enlarged cross-sectional view of a portion of a schematic configuration of the conveyance device in the standby state. On the other hand, FIG. 3B is a enlarged cross-sectional view of a portion of a schematic configuration of the conveyance device in the conveyance state.

The cam gear 2 is arranged so as to be sandwiched between the sheet feed roller 1 and the frame member 14, and the gear shaft 23 serving as a center of rotation of the cam gear 2 is located at a slightly shifted position from the sheet feed roller 1. The worm gear 3*b* integrally configured with the shaft portion 3*a* is coupled to an oblique tooth gear 2*c* which is formed on an outer circumference of the cam gear 2.

When the gear 3*c* is driven and rotated under the control described below, the cam gear 2, in synchronism therewith, also rotates around the gear shaft 23 as the rotation central axis. The cam gear 2 has a cam curve which smoothly connects a cam face 2*a* at a higher side and a cam face 2*b* at a lower side. For this reason, when the cam gear 2 is driven and rotated, the shaft portion 1*a* of the sheet feed roller moves from a position illustrated in FIG. 3A to a position illustrated in FIG. 3B, so as to ride on the cam curve face of the cam gear 2. Processing operation for moving the sheet feed roller 1 will be described in detail below.

Figure 4A:
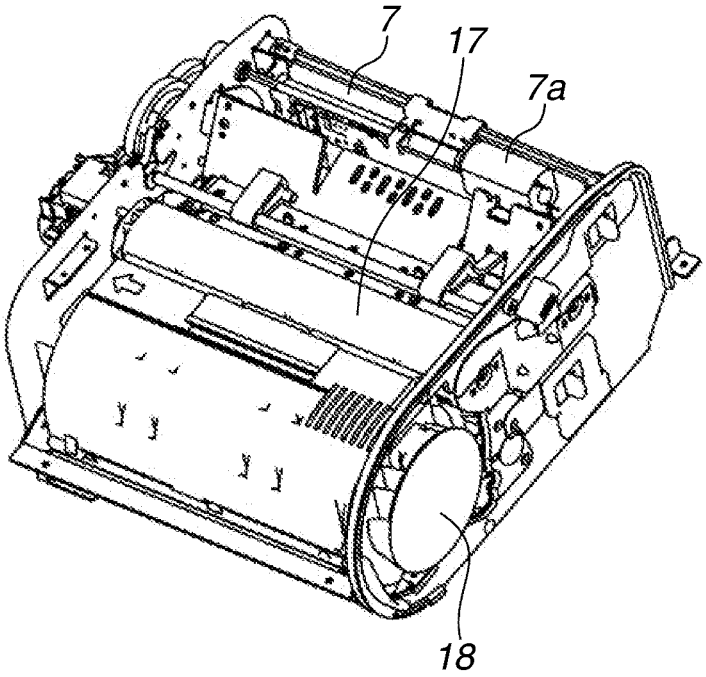
FIG. 4A is a perspective view of the front side of the printing apparatus according to the exemplary embodiment of the present invention.
Figure 4B:
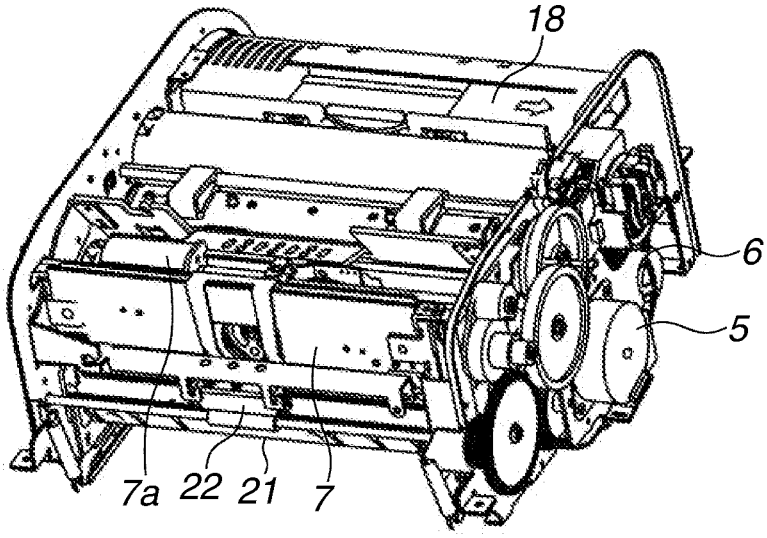
FIG. 4B is a perspective view of the rear side of the printing apparatus according to the exemplary embodiment of the present invention.

FIG. 4A is a perspective view of the front side of the printing apparatus according to the exemplary embodiment of the present invention, and FIG. 4B is a perspective view of the rear side of the same printing apparatus.

In the present exemplary embodiment, the ink ribbon cassette 17 and the roll paper cassette 18 are loaded from one direction in common, relative to the printing apparatus side surface. Thereby, each cassette can be quickly and surely mounted and dismounted, and the printing apparatus being easily handled can be provided.

Further, a degree of freedom relating to installation of the apparatus is increased and, for example, a configuration in which a lengthwise direction of the apparatus is turned to an upright position, and an obliquely inclined configuration can be realizable. Furthermore, in a case where a lid member for covering each cassette from outside the apparatus is provided, a single lid member can be shared, and a number of parts can be reduced, which is useful in terms of reduction in cost.

Hereinabove, a configuration of the printing apparatus has been described. Here, supplemental explanations about the roll paper cassette 18 will be further given referring to FIG. 5. FIG. 5 is a cross-sectional view illustrating a schematic configuration of the roll paper cassette 18.

The roll paper P is wound cylindrically around the bobbin 18*a*, and the bobbin 18*a* is held within the roll paper cassette 18 in a slidable manner in the substantially up-and-down direction (vertical direction) in FIG. 5. Furthermore, the bobbin 18*a* abuts against the spring member 18*d*, and is urged in a substantially downward direction. In the roll paper cassette 18, the slit-like roll paper exit 18*b* is provided at a portion of the outer circumferential surface, so that the roll paper P can be pulled out from within the roll paper cassette 18.

As illustrated in FIG. 2B, if the sheet feed roller 1 is located at a press-contacting position, the roll paper P and the sheet feed roller 1 become in the press-contacted state with each other by the spring member 18*d* via the bobbin 18*a*. In this process, if the sheet feed roller 1 is driven and rotated in a sheet feeding direction, the cylindrically wound roll paper P as a whole is rolled by a frictional force of surfaces between the sheet feed roller 1 and the outer circumferential surface of the roll paper P.

At this time, the separating member 18*c* is urged against the outer circumferential surface of the cylindrically wound roll paper P, and the leading edge of the roll paper P is fed to the conveyance path by being guided by the separating member 18*c*. At the start of use, as illustrated in FIG. 5, a winding diameter of the cylindrically wound roll paper P is large, and occupies almost a whole space within the sheet cassette.

On the other hand, as a consumption of the roll paper P goes on along with a number of photographic printing, the winding diameter of the roll paper P becomes smaller. The spring member 18*d* has functions of not only bringing the outer circumferential surface of the roll paper P into pressure contact with the sheet feed roller 1, but also, shifting the roll paper P to one side of a position to which the leading edge of the roll paper P is picked up and guided by the separating member 18*c*, even when the winding diameter of the roll paper P has become small.

For this reason, a stroke of the spring member 18*d* is relatively large, and is set so that the cylindrically wound roll paper P can be shifted to one side in a substantially downward direction in FIG. 5, constantly from the start of use to the last one wind, and the roll paper P can be press-contacted with the sheet feed roller 1.

FIGS. 6A to 6D are side views illustrating a schematic configuration of a conveyance device according to the exemplary embodiment of the present invention, and illustrating a flow of a series of operations from the standby state to the conveyance state.

A pinion gear 5*a* is pressure-fitted into a rotation shaft of the sheet feed motor 5, and a two-stage gear 24 consists of a large-diameter gear and a small-diameter gear. A gear 19*a* is press-fitted into a shaft portion of the capstan roller 19, and is integrally configured with the capstan roller 19. The pinion gear 5*a* transmits a rotational driving force of the sheet feed motor 5 to the gear 19*a*, while decelerating, via the two-stage gear 24.

The planet unit 6 includes a sun gear 6*a*, which is a two-stage gear, in which a large-diameter gear is constantly coupled to the gear 19*a*, a planet gear 6*b* constantly coupled to a small-diameter gear of the sun gear 6*a*, and a planet lever 6*c* which holds the planet gear 6*b*, and swings around a rotation shaft of the sun gear 6*a*. Here, the planet gear 6*b* is coupled to or separated away from the gear 3*c* by swinging of the planet lever 6*c*.

Figure 6A:
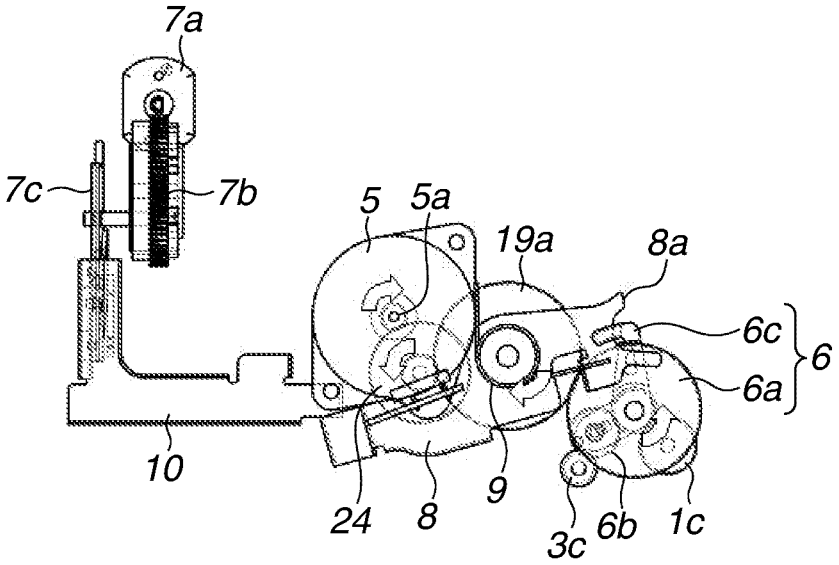
FIG. 6A is a side view illustrating a schematic configuration of a first-stage of a conveyance device illustrating a series of operations from the standby state to the conveyance state according to the exemplary embodiment of the present invention.
Figure 6B:
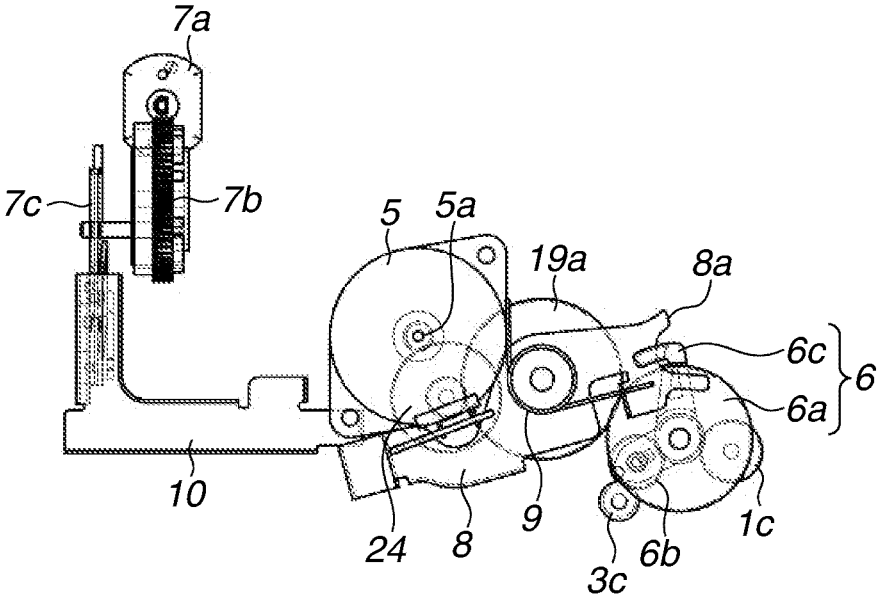
FIG. 6B is a side view illustrating a schematic configuration of a second-stage of the conveyance device illustrating a series of operations from the standby state to the conveyance state according to the exemplary embodiment of the present invention.
Figure 6C:
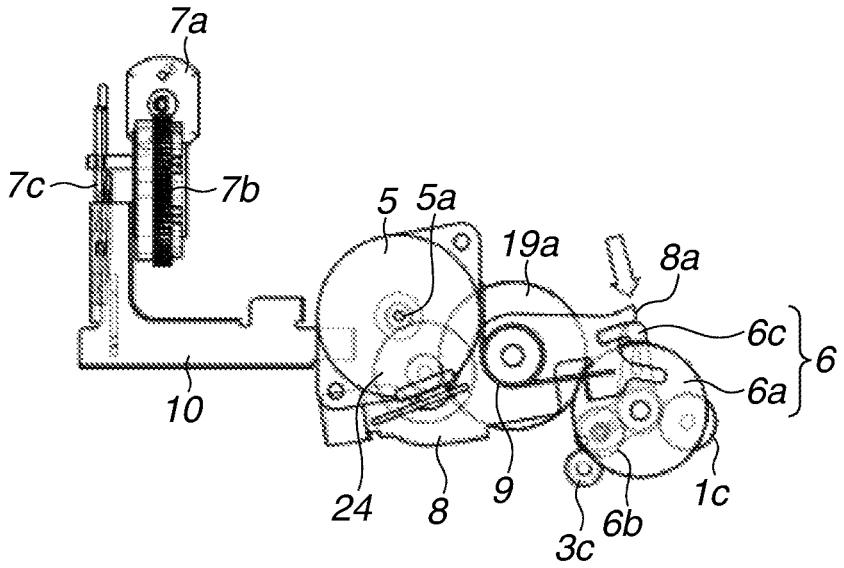
FIG. 6C is a side view illustrating a schematic configuration of a third-stage of the conveyance device illustrating a series of operations from the standby state to the conveyance state according to the exemplary embodiment of the present invention.
Figure 6D:
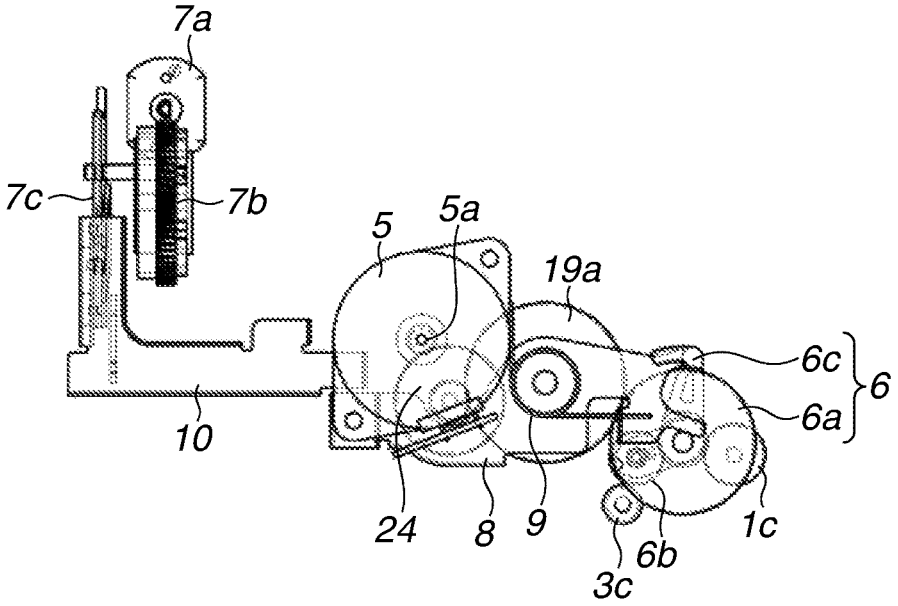
FIG. 6D is a side view illustrating a schematic configuration of a fourth-stage of the conveyance device illustrating a series of operations from the standby state to the conveyance state according to the exemplary embodiment of the present invention.

The regulating lever 8 can be turned around the capstan roller 19 as a rotational axis, from a position illustrated in FIG. 6A to a position illustrated in FIG. 6D. On the other hand, the interlocking lever 10 can move between the positions where the movable cutter blade 7*c* is positioned at the cutting position as a second state or the position illustrated in FIG. 6A, which is at the cutting state (lowermost point), and where the movable cutter blade 7*c* is positioned at the next position. In other words, the movable cutter blade 7*c* can reciprocatingly move to the non-cutting state as a first state or a position illustrated in FIG. 6D, which is in the non-cutting state (uppermost point).

FIG. 6A is a side view when the cutter unit 7 is located at the cutting position, and the sheet feed roller 1 is located at the retraction or separating position, and FIG. 6B is a side view when the sheet feed roller 1 moves to the press-contacting position therefrom.

In FIGS. 6A and 6B, the interlocking lever 10 is positioned at the cutting position (lowermost point) interlocking with the movable cutter blade 7*c*, and abuts against an end of one side of the regulating lever 8. At this time, the regulating portion 8*a* provided at another end of the regulating lever 8 is separated from the planet lever 6*c*, and the planet gear 6*b* and the gear 3*c* can be coupled to each other. In this process, when the sheet feed motor 5 is driven and rotated, in a direction of an arrow (clockwise) in FIG. 6A, the planet gear 6*b* is coupled to the gear 3*c*, and the gear 3*c* is driven and rotated.

Figure 7A:
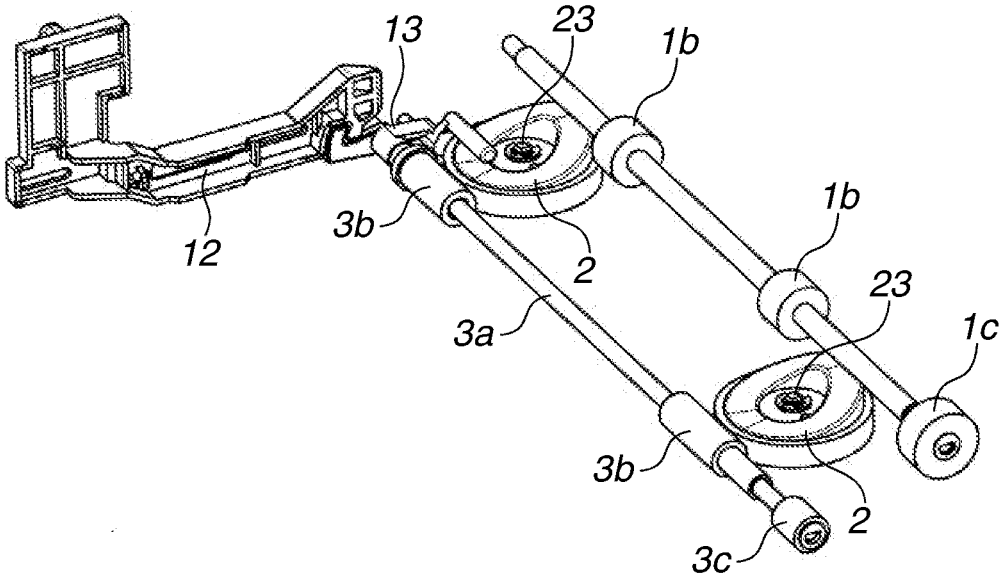
FIG. 7A is a perspective view in a sheet feed roller press-contacting state illustrating a portion of components for a switching mechanism between press-contacting and retraction positions and a sheet cassette locking mechanism of the sheet feed roller according to the present invention.
Figure 7B:
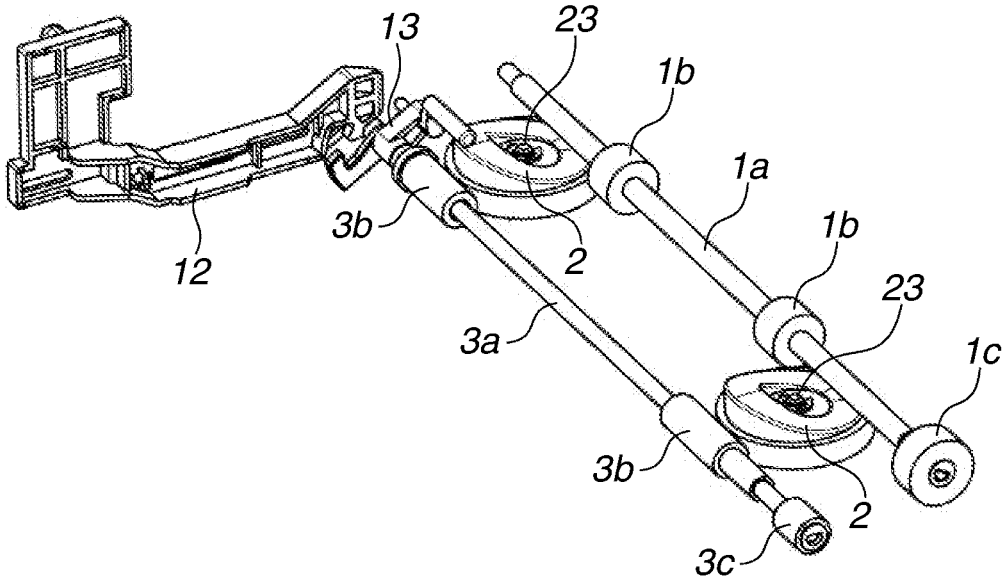
FIG. 7B is a perspective view in a sheet feed roller retraction state illustrating a portion of components for a switching mechanism between press-contacting and retraction positions and a sheet cassette locking mechanism of the sheet feed roller according to the present invention.

Referring to FIGS. 7A and 7B, an operation of components which operates in interlocking with the gear 3*c* will be described. FIGS. 7A and 7B are perspective views illustrating a portion of principal constituent elements according to the present invention, i.e., as described above, the interlocking components of the switching mechanism between the press-contacting and the retraction positions of the sheet feed roller 1, and the locking mechanism which prevents the draw-out of the sheet cassette. FIG. 7A illustrates a state where the sheet feed roller 1 is positioned at the press contacting position, and FIG. 7B illustrates a state where the sheet feed roller 1 is positioned at the retraction position.

The gear 3*c*, as described above, is pressure-fitted into the shaft portion 3*a* in piercing-with-skewer fashion together with two worm gears 3*b*, and they operate integrally as the gear shaft unit 3. For this reason, when the gear 3*c* rotates, the two worm gears 3*b* also concurrently rotate, and the two cam gears 2, which mesh with the worm gears 3*b* with oblique teeth 2*c* located on the outer circumferential portion, rotate around the gear shafts 23.

As illustrated in FIGS. 3A and 3B, and as described above, when the cam gears 2 are driven and rotated, the sheet feed roller 1 is raised along a cam curved surface of the cam gears 2. The sheet feed roller 1 moves as rotating around a rotation shaft of the sun gear 6*a*, so that the gear 1*c* and the sun gear 6*a* remain constantly coupled to each other.

At this time, the sheet feed roller 1 is raised to the press-contacting position illustrated in FIG. 7A, by monitoring positions of the cam gears 2 by a sensor (not illustrated), and stopping the cam gears 2 after having detected that the cam gears 2 have been rotated to a predetermined stop position at which the cam gears 2 have been rotated around the gear shafts 23 by about 180 degrees.

At that time, the conveyance device becomes the state as illustrated in FIG. 6B. From this state, if the cutter motor 7*a* is further driven and rotated, and the movable cutter blade 7*c* is moved to the non-cutting position (uppermost point), the conveyance device becomes the state as illustrated in FIG. 6C.

FIGS. 6C and 6D are side views illustrating the state in a case where the cutter unit 7 is positioned at the non-cutting position, and the sheet feed roller 1 is positioned at the press-contacting position, and in particular, FIG. 6C is a side view illustrating the state when the regulating portion 8*a* of the regulating lever 8 abuts against the planet lever 6*c*.

The movable cutter blade 7*c* moves to the uppermost point as the non-cutting position, thereby the interlocking lever 10 and an end of one side of the regulating lever 8 are separated from each other. The regulating lever 8 is urged by the torsion spring 9, so that the regulating lever 8 is latched at a position illustrated in FIG. 6D. For this reason, when the interlocking lever 10 is separated from the end of one side of the regulating lever 8, the regulating lever 8 is turned in a direction of an arrow illustrated in FIG. 6C (clockwise).

Then, the planet lever 6*c* and the regulating portion 8*a* of the regulating lever 8 abut against each other, and become the state illustrated in FIG. 6C. At this time, the sheet feed motor 5 is not yet driven and rotated, and it is easy to press and swing the planet lever 6*c*. For this reason, the regulating portion 8*a* presses and swings the planet lever 6*c* by being urged by the torsion spring 9, thereby causing the planet gear 6*b* to be separated from the gear 3*c*, thus the state becomes as illustrated in FIG. 6D.

If the planet gear 6*b* is in the state illustrated in FIG. 6D, a coupling of the planet gear 6*b* and the gear 3*c* is regulated. As a result, the cam gear 2 is never driven and rotated, even if the sheet feed motor 5 is driven and rotated in whichever direction.

On the other hand, the planet gear 6*b* is always gear-coupled to the gear 1*c*, and when the sheet feed motor 5 is driven, the gear 19*a*, which rotates integrally with the capstan roller 19 which performs sheet feeding, and the gear 1*c* rotates in the same direction, and thus the sheet feed roller 1 rotates interlocking with the gear 1*c*. In this way, the sheet feed roller 1, at a sheet press-contacting position, can convey the sheet in the same direction as that of the capstan roller 19.

A procedure for moving the sheet feed roller 1 from the press-contacting position to the retraction position, and shifting the process from the conveyance state to the standby state, can be described based on an almost reverse procedure of contents which have been herein described. More specifically, in order to make the planet gear 6*b* and the gear 3*c* to be coupled and decoupled to each other, the regulating lever 8 is turned from the position in FIG. 6D to a position in FIG. 6B, by a press-contacting action of the interlocking lever 10. During the course of the process, the regulating portion 8*a* is separated from the planet lever 6*c*, and a regulation of the coupling of the plane gear 6*b* and the gear 3*c* is released.

From this state, if the sheet feed motor 5 is driven and rotated clockwise in FIG. 6B, a rotation transmitted to the gear 3*c* will drive and rotate the cam gear 2, which lowers the sheet feed roller 1, through the worm gear 3*b*, and the state shifts from the state illustrated in FIG. 6B to the state illustrated in FIG. 6A, then the state becomes the standby state. In this way, in the present exemplary embodiment, switching between the press-contacting position and the retraction position of the sheet feed roller 1 is enabled, depending on a position of the movable blade 7*c* of the cutter unit 7 as a switching unit.

Figure 8A:
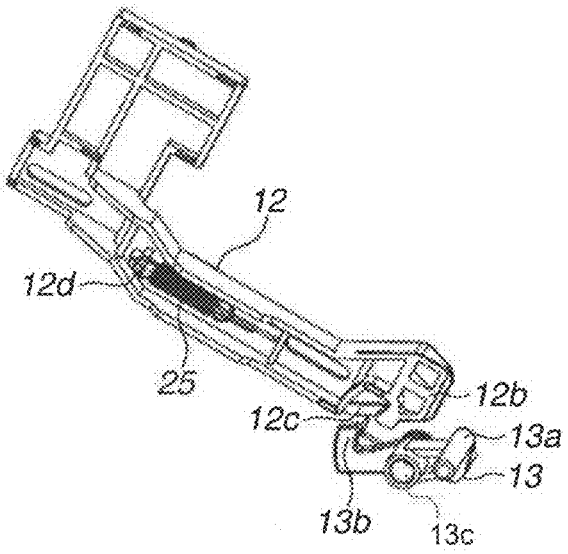
FIG. 8A is a rear perspective view of the locking mechanism components of the sheet cassette according to the present invention.
Figure 8B:
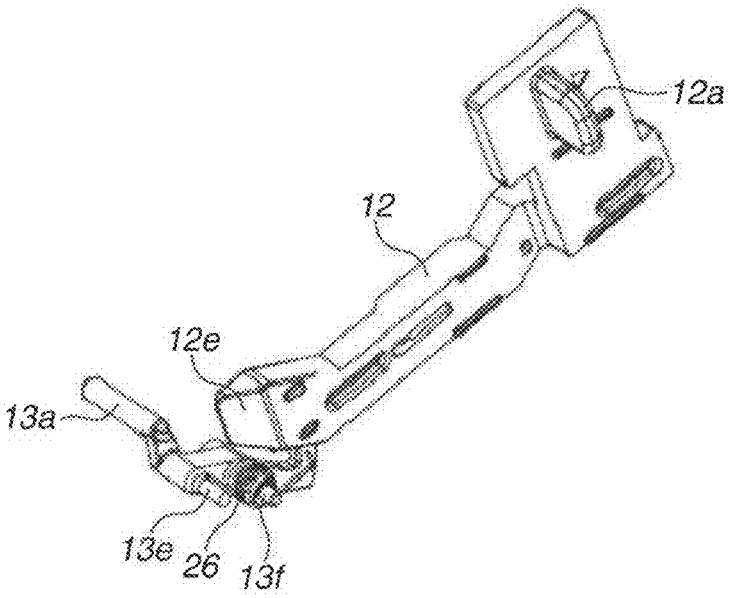
FIG. 8B is a front perspective view of the locking mechanism components of the sheet cassette according to the present invention.

Here, the principal constituent elements according to the present invention, i.e., as described above, the principal components of the locking mechanism for preventing the draw-out of the sheet cassette, in association with an operation of switching between the press-contacting and retraction positions of the sheet feed roller 1, will be described in detail with reference to FIGS. 8A and 8B. First, FIG. 8A is a rear perspective view illustrating the interlocking member 13 between the locking member 12 and the sheet feeding mechanism, as components of the sheet cassette locking mechanism, and respective urging members. FIG. 8B illustrates a front perspective view.

In the locking member 12, there are formed a knob shape 12*a* which the user manipulates for a drawing-out operation of the sheet cassette 18, and an abutting portion 12*b* for abutting against the sheet cassette 18 to press the cassette, and locking its position. Further, the locking member 12 also functions as an operation lever component.

Further, on a rear face, a recessed portion 12*c* surrounded by ribs to allow a lock key shape 13*b* of the interlocking member 13 to enter thereof, and a spring hook shape 12*d* for hooking an urging spring 25, which urges the locking member 12 in a locking direction, are formed.

Furthermore, on a back side of the cassette abutting portion 12*b*, an inclined portion 12*e* is provided. The sheet cassette 18 pushes in an inclined surface of the inclined portion 12*e*, thereby causing the locking member 12 to smoothly retract, and as a result, the loading of the sheet cassette 18 is enabled.

Further, the interlocking member 13 is a member which is turned around a rotation central axis of a hole 13*c* and a cylindrical portion 13*f*, which is coaxial with the hole 13*c*. On the interlocking member 13, there is formed a cam lever shape 13*a*, which operates interlocking by abutting against the cam gear 2, and the lock key shape 13*b*. The cam gear 2 performs elevation of the sheet feed roller 1. The lock key shape 13*b* enters into the recessed portion 12*c* of the locking member 12, and regulates a movement of the locking member 12.

The cam lever shape 13*a* abuts against a different area from an area at which the sheet feed roller 1 abuts against the cam gear 2. A coil portion of the torsion spring 26 fits into the vicinity of a base position of the cylindrical portion 13*f*, and an urging force is exerted on an arm portion 13*e*, thereby the cam lever shape 13*a* of the interlocking member 13 is designed to always abut against a cam face of the cam gear 2 of the sheet feed roller.

Next, an operation of the locking mechanism and a positioning method of the sheet cassette will be described with reference to FIGS. 9A to 10C.

Figure 9A:
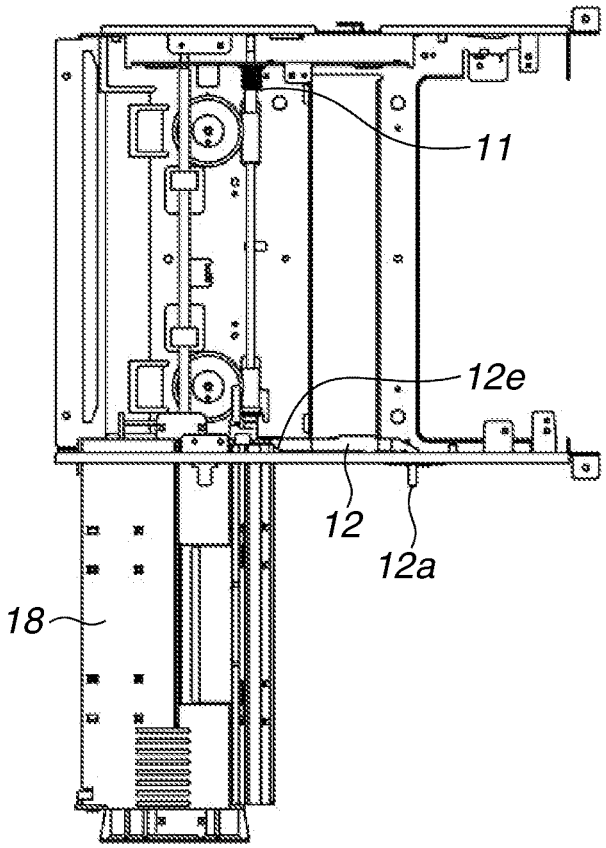
FIG. 9A is a top view illustrating a sheet cassette loading starting state according to the exemplary embodiment of the present invention.
Figure 9B:
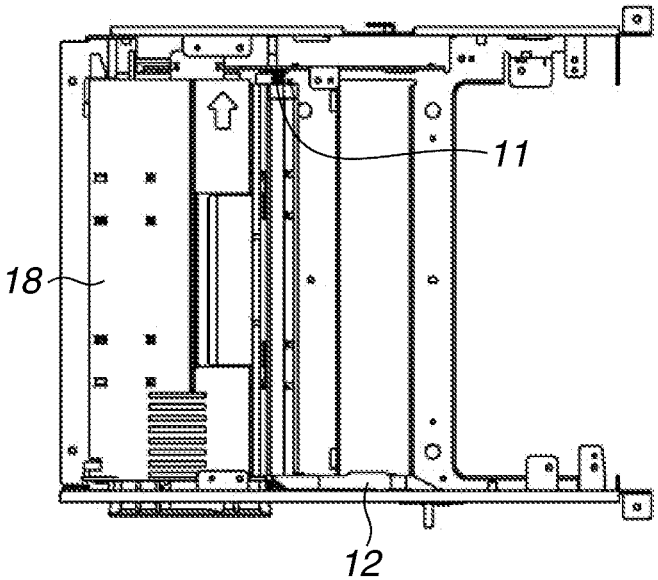
FIG. 9B is a top view illustrating a positioning state after loading the sheet cassette according to the exemplary embodiment of the present invention.

FIG. 9A is a top view illustrating the sheet cassette 18 in the middle of loading, and FIG. 9B illustrates the sheet cassette the position of which is determined after the sheet cassette has been loaded. On the other hand, FIG. 10A is a cross-sectional view illustrating a cam portion of the sheet cassette locking mechanism in the middle of loading according to the exemplary embodiment of the present invention.

Figure 10A:
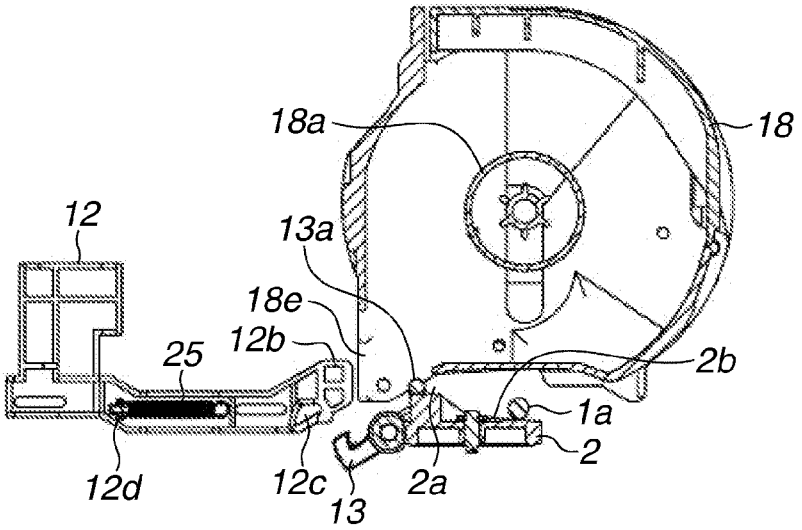
FIG. 10A is a cross-sectional view of a cam unit of the sheet cassette locking mechanism in the middle of loading according to the exemplary embodiment of the present invention.
Figure 10B:
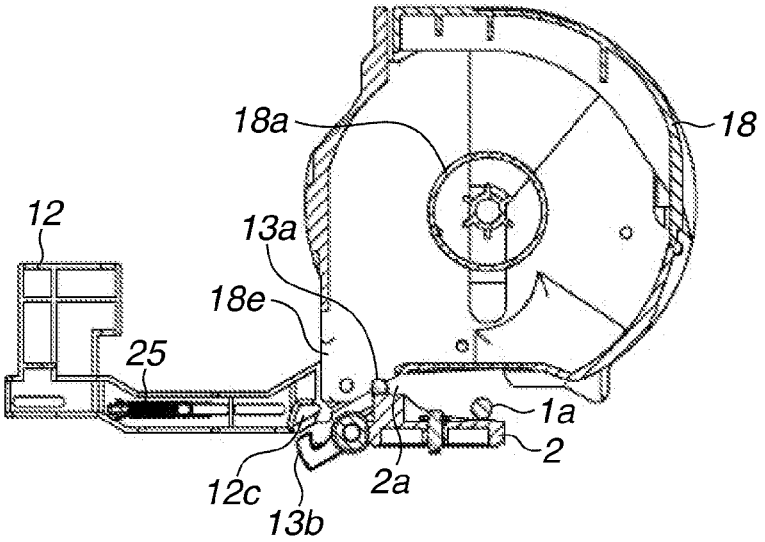
FIG. 10B is a cross-sectional view of the cam unit of the sheet cassette locking mechanism in the standby state after loading according to the exemplary embodiment of the present invention.
Figure 10C:
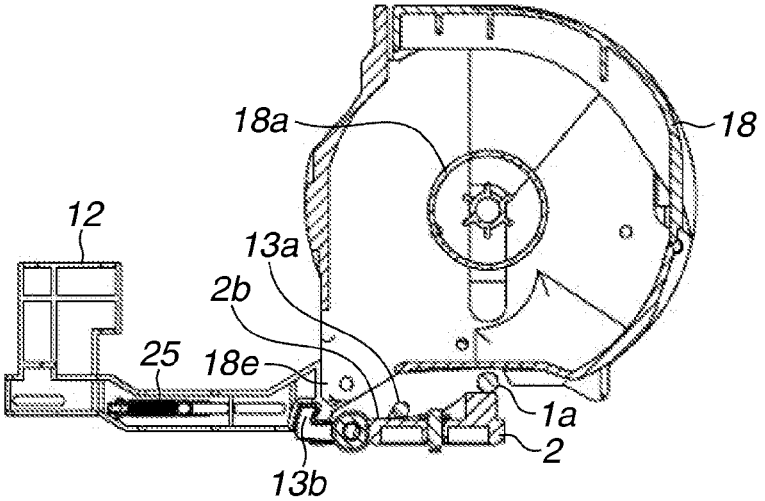
FIG. 10C is a cross-sectional view of the cam unit of the sheet cassette locking mechanism during a photographic printing operation according to the exemplary embodiment of the present invention.

FIG. 10B is a cross-sectional view of the cam portion of the sheet cassette locking mechanism in the standby state after loading, and FIG. 10C is a cross-sectional view of the cam portion of the sheet cassette locking mechanism during photographic a printing operation.

As the sheet cassette 18 is beginning to be loaded into the printing apparatus, the sheet cassette 18 abuts against the inclined surface 12*e* of the locking member 12 as illustrated in FIG. 9A. As the sheet cassette 18 is further pushed in, the locking member 12 is forced to retract in a non-locking direction, i.e., a rightward direction in FIG. 9A. The cross-sectional view of the cam gear 2 when the locking member 12 has completely retracted at this time is illustrated in FIG. 10A. In FIG. 10A, the state of respective components in the middle of loading of the sheet cassette 18 will be described.

At the time of the loading of the sheet cassette, the sheet feed roller 1 needs to be retracted to the position in FIG. 10*a*, accordingly the shaft portion 1*a* rides on the cam face 2*b* of a lower side of the cam gear 2. On the other hand, the cam lever shape 13*a* of the interlocking member 13 rides on the cam face 2*a* of a higher side of the cam gear 2. At this time, the lock key shape 13*b* is in a retracted state with respect to the locking member 12.

Next, a state where the loading of the sheet cassette 18 is finished will be described with reference to FIGS. 9B and 10B.

As the sheet cassette 18 is being pushed in, the sheet cassette 18 pushes in and compresses the cassette urging member 11. When the sheet cassette 18 is pushed in beyond the abutting surface 12*b* of the locking member 12, the locking member 12 is returned to the locking position by the urging spring 25.

Then, as illustrated in FIG. 10B, the sheet cassette 18 receives the force in a direction in which the sheet cassette 18 is pushed out by the cassette urging member 11. Thereby, a flange portion 18*e*, provided at a portion of an outer wall of the sheet cassette 18, and the abutting portion 12*b* of the locking member 12 are engaged with each other in an overlapping manner in a mounting/withdrawal direction.

As can be seen from FIG. 8B at this time, in a state where the sheet cassette 18 is pressed by the cassette urging member 11 from the back side of the apparatus, the locking member 12 presses the outer wall of the sheet cassette 18 arranged so as to be opposed to the cassette urging member 11, and thereby a position of the cassette is fixed.

On the other hand, FIG. 10C illustrates the state during photographic printing operation, wherein the cam gear 2 rotates from the state in FIG. 10B, and the shaft portion 1*a* of the sheet feed roller 1 reaches the top cam face 2*a* at the higher side. On the other hand, in the interlocking member 13 utilizing the opposite cam face 2*b*, the cam lever shape 13*a* turns in a clockwise direction on FIG. 10C along the cam face, and abuts against the top of the cam face 2*b* at the lower side of the cam gear 2. Then, the cam lever shape 13*a* of the interlocking member 13 enters into the recessed portion 12*c* of the locking member 12

In this state, the user attempts to move the locking member 12 serving also as an operation lever in the cassette drawing-out direction, to draw out the sheet cassette 18. Then, the lock key shape 13*b* (engaging portion) of the interlocking member 13 engages with the recessed portion (portion to be engaged) of the locking member 12, and regulates a movement of the locking member 12. Therefore, the abutting surface 12*b* against the sheet cassette 18 of the locking member 12 will never be disconnected from the flange portion 18*e* of the cassette. As a result, the sheet cassette 18 cannot be drawn out during photographic printing.

At this time, the lock key shape 13*a* of the interlocking member 13 has some play, with respect to the recessed portion of the locking member 12, in a state where the lock key shape 13*a* has entered thereinto. However, even if the locking member 12 is operated, by an amount of the play, the locking member 12 only slidingly moves in an orthogonal direction to the loading direction of the cassette, and a position of the abutting surface 12*c* against the cassette will never be changed relative to the mounting/withdrawal direction.

Therefore, also in a configuration sensitive to an accuracy of the position of the sheet cassette, in which the conveyance direction of the sheet and the loading direction of the sheet cassette intersect at right angles as the present exemplary embodiment, a user's erroneous operation to draw out the sheet cassette during photographic printing will not exert influence on the position of the sheet cassette.

Further, by giving an amount of play, while the locking member 12 and the interlocking member 13 are engaged with each other, the movement of the locking member 12 can be surely regulated, without producing failures such as some positional deviations or poor meshing that may occur due to insufficient tolerances of components.

In this way, without exerting influence on a positional accuracy of the sheet cassette due to erroneous operation or an action for locking, the draw-out of the sheet cassette during photographic printing can be surely prevented. Further, since there is no need to provide a new actuator for locking action, by utilizing the elevation operation of the sheet feed roller, the locking mechanism can be configured at a low cost.

Furthermore, a portion where the positional accuracy is most necessary for the sheet cassette is in the vicinity of the sheet feed port from which the sheets are fed out. For this reason, it is desirable to provide a portion where the position of the cassette is to be most accurately defined, in the vicinity of the sheet feed port, and therefore the flange portion 18*e* according to the present exemplary embodiment is preferably provided in the vicinity of the sheet feed port. On the other hand, when the sheet feed roller is disposed closer to the sheet feed port, sheet feeding reliability is higher.

Therefore, since the elevation mechanism of the sheet feed roller is positioned close to the locking portion of the locking member, the interlocking mechanism for the cassette locking described above can be constituted small and using simple components.

Figure 11:
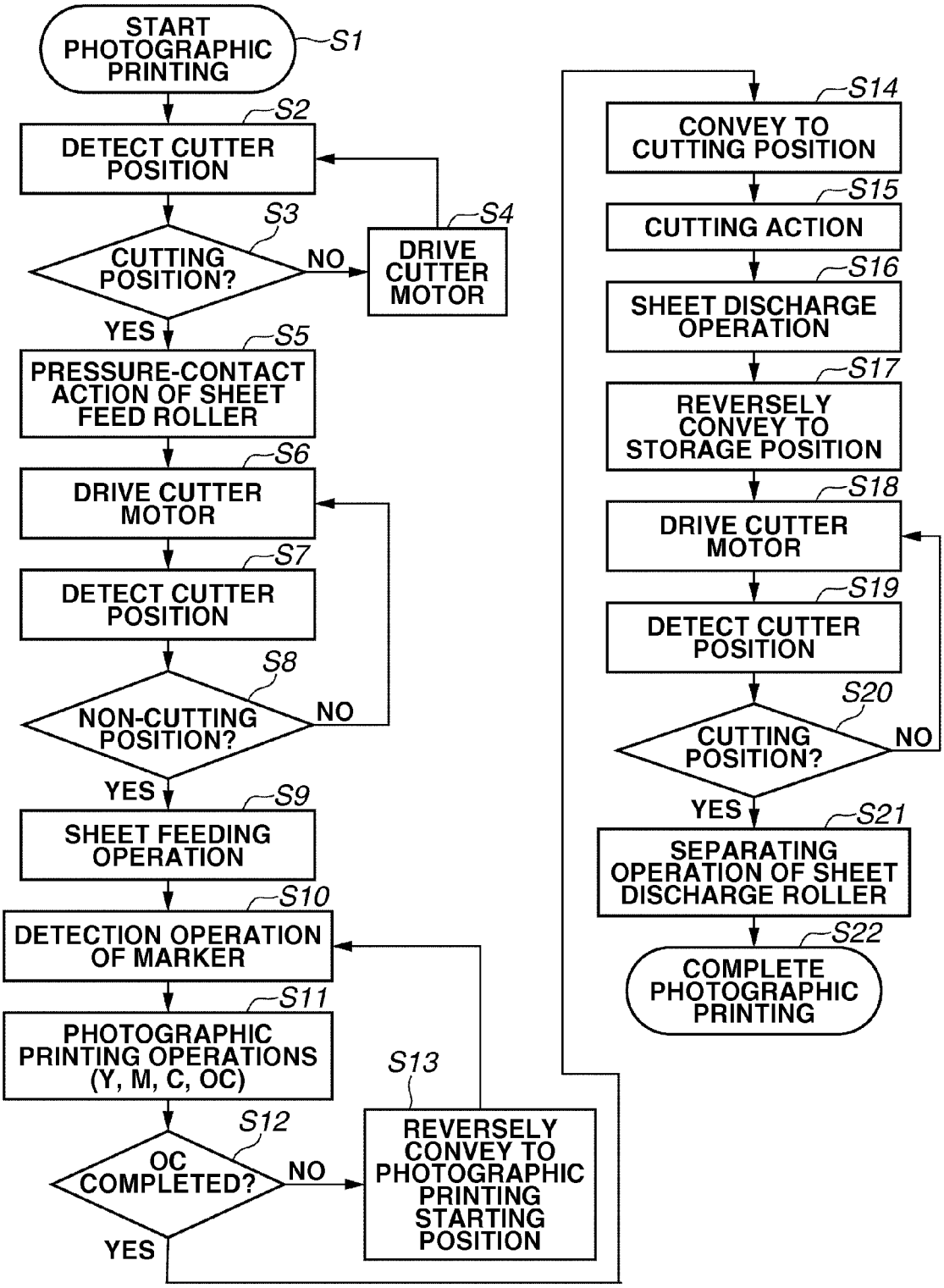
FIG. 11 is a flowchart illustrating a series of processing operations according to the exemplary embodiment of the present invention.

FIG. 11 is a flowchart illustrating a series of processing operations according to the exemplary embodiment. A series of processing operations from the photographic printing start to photographic printing completion, including operations which have been already described, will be described in sequence.

In step S1, a user selects the photographic printing start by pressing an operation button (not illustrated), while the ink ribbon cassette 17 and the roll paper cassette 18 are mounted on the apparatus main body. Next, in step S2, the cutter position is detected. This is a preparatory operation of the press-contacting action (in step S5) of the sheet feed roller 1 to be performed later.

Only when the movable cutter blade 7*c* is positioned at the cutting position (lowermost point) as described above, a transmission of a power to the cam gear 2 is performed, thereby enabling the cam gear 2 to be driven and rotated, and enabling the sheet feed roller 1 to be press-contacted.

For this reason, in step S3, it is necessary to detect whether the movable cutter blade 7*c* is located at the cutting position (lowermost point), before the press-contacting action (in step S5) of the sheet feed roller 1 is performed. At this time, if the movable cutter blade 7*c* is not located at the cutting position (lowermost point) (NO in step S3), then in step S4, a control is performed so that the cutter motor 7*a* is driven and rotated, and the movable cutter blade 7*c* is moved to the cutting position (lowermost point).

Next, in step S5, the sheet feed motor 5 is driven and rotated to perform pressure-contacting action of the sheet feed roller 1. In this process, as illustrated in FIGS. 6A and 6B, and as described above, the sheet feed motor 5 is driven and rotated clockwise, thereby power is transmitted through the gears 24, 19*a*, 6*a*, and 6*b*, and eventually the gear 3*c* is driven.

In this process, the worm gear 3*b* is coaxial with and rotates integrally with the gear 3*c*, and the cam gear 2, which engages with the worm gear 3*b*, rotates about 180°, accordingly the sheet feed roller 1 moves along the cam face of the cam gear 2 to the press-contacting position.

At this time, cross-sections of components located near the cam gear 2 become the state illustrated in FIG. 10C. When the sheet feed roller 1 moves to the press-contacting position as described above, the lock key shape 13*b* of the interlocking member 13 enters into the recessed portion 12*c* of the locking member 12, and moves to a position at which the movement of the locking member 12 can be regulated.

After that, in step S6, cutter motor 7*a* is driven to move the movable cutter blade 7*c* to the non-cutting position (uppermost point). Thereby, as described above, a coupling of the planet gear 6*b* and the gear 3*c* is regulated, and even if the sheet feed motor 5 is driven and rotated in whichever direction, the cam gear 2 is not driven. For this reason, it becomes impossible to draw out the sheet cassette 18, before the cam gear 2 is rotated, while the photographic printing is completed.

Next, after the movable cutter blade 7*c* has been moved to the non-cutting position (uppermost point) (YES in step S8), then, in step S9, sheet feeding operation is performed.

In a state illustrated in FIG. 2B, when the sheet feed roller 1 is driven and rotated in the sheet feeding direction by a drive transmission mechanism described above, the leading edge of the roll paper P wound around the bobbin 18*a* advances along an inner circumferential surface of the roll paper cassette 18.

After that, the leading edge of the roll paper P is picked up by the separating member 18*c*, and at this time when the sheet feed roller 1 is further driven and rotated in the sheet feeding direction, the leading edge of the roll paper P is guided by the separating member 18*c* and led to the roll paper exit 18*b*.

The fed roll paper P is further conveyed by the sheet feed roller 1, and is sandwiched by the roller pair consisting of the capstan roller 19 and the pinch roller 20 arranged so as to be opposed to each other. At this time, the sheet feed roller 1, since it is synchronized with rotating action of the capstan roller 19, continues to feed out the roll paper P in the sheet feeding direction from the roll paper cassette 18.

After that, the roll paper P necessary for performing photographic printing of one image is fed out from the roll paper cassette 18, according to the detection information of a detection sensor (not illustrated), and is conveyed to the photographic printing starting position and stopped there. When a conveyance of the roll paper P to the photographic printing starting position is completed, next, in step S10, detection operation of marker is enabled.

More specifically, in the process of winding up the ink ribbon 17*a* stored in the ink ribbon cassette 17, via a motor (not illustrated) and a gear array (not illustrated) connected to the motor, the positioning of the leading position of the ink ribbon 17*a* is performed.

Generally, the detection operation of marker performed in step S10 is an operation for detecting that a light-receiving level of an optical sensor (not illustrated) has become equal to or less than a certain level, and determining the position of light shielding marker provided in the ink ribbon 17*a*.

After the marker detection operation performed in step S10, then in step S11, photographic printing operations are performed with regard to respective frames for Y, M, C, and OC. The photographic printing operations performed in step S11 from the photographic printing starting position to the photographic printing completion position, are performed during the conveyance of the roll paper P and the ink ribbon 17*a* in an upstream direction (storing direction of the roll paper P).

First, the mounting frame 15*b* is turned to a predetermined position under control of a cam gear (not illustrated), thereby pressing the heating portion 15*a* integrally configured with the mounting frame 15*b* against the platen roller 16. After that, the ink ribbon 17*a* is wound around the take-up bobbin at the same time with the roll paper P, and is conveyed while removing slack.

The photographic printing completion position at this time is a position to which the leading edge of the roll paper P moves to the roll paper cassette 18 side (upstream side) after having passed through the position between the thermal head 15 and the platen roller 16 opposed to each other.

Next, in step S13, the roll paper P is reversely conveyed from this position to the photographic printing starting position. At the time of reverse conveyance in step S13 to the photographic printing starting position, the mounting frame 15*b* is turned again, and the heating portion 15*a* is retracted to a predetermined retraction position.

After having further reversely conveyed the roll paper P to the photographic printing starting position in step S13, a desired photographic printing image is thermally transferred onto the roll paper P by sequentially superimposing inks on the roll paper P while repeating the photographic printing operations in step S11, similar to the operations so far with regard to the remaining frames from there.

Finally, in step S12, from the fact that photographic printing of the OC serving as a protective layer is completed, it is determined that the photographic printing operations are completed (YES in step S12). In step S14, the roll paper P is conveyed to the cutting position. In step S15, the cutting action of the roll paper P is performed.

In the middle of conveyance to the cutting position in step S14, the roll paper P is sandwiched by the roller pair consisting of the sheet discharge roller 21 and the sheet discharge pinch roller 22, and is further conveyed in the sheet discharging direction. A stop position as the cutting position is a position at which a boundary between a photographic printing region and a non-photographic printing region of the roll paper P coincides with the cutting position of the cutter unit 7.

In step S15, the cutting action is performed in order to cut the roll paper P at a boundary between the photographic printing portion and the margin, after having conveyed the roll paper P to the cutting position in step S14. As the cutting action in step S15, the cutter motor 7*a* is driven and rotated to move the movable cutter blade 7*c* to the cutting position. At this time, as described above, the movable cutter blade 7*c* and the fixed cutter blade 7*d* cut the roll paper P by sliding relative to each other in a scissor-like fashion.

In a state where the roll paper P has been cut, the movable cutter blade 7*c* has been moved from the non-cutting position (uppermost point) to the cutting position (lowermost point). From this position, the movable cutter blade 7*c* is again returned to the non-cutting position (uppermost point) before the cutting action to set the cutter blade 7*c* to the standby state. At this time, the cut roll paper P is in a state where it is sandwiched by the roller pair consisting of the sheet discharge roller 21 and the sheet discharge pinch roller 22.

In step S16, a sheet discharge operation is performed, in order to discharge the cut roll paper P to a paper receiving unit (not illustrated), after the cutting action in step S15. At the time of the sheet discharge of the cut roll paper P in step S16, the cut roll paper P is conveyed in a downstream direction (the sheet discharge direction) further from the photographic printing completion position, only by a holding force of the roller pair consisting of the sheet discharge roller 21 and the sheet discharge pinch roller 22.

A driving force from the sheet feed motor 5 is transmitted by the gear array (not illustrated), and the sheet discharge operation in step S16 is performed by the sheet discharge roller 21, in synchronization with the capstan roller 19. For this reason, at the time of the sheet discharge operation in step S16, the leading edge of the roll paper P not yet photographic-printed also advances in the sheet discharge direction along with the conveying operation at the time of the sheet discharge.

As a result, the cut roll paper P, after it has been sent in the sheet discharge direction by the sheet discharge roller 21, is pushed out by the leading edge of the roll paper P not yet subjected to photographic printing, which has come from an upstream side, and is discharged to the outside of apparatus. In step S16, the cut roll paper P thus discharged is neatly stacked on the paper receiving unit (not illustrated), and the sheet discharging operation is completed.

After the sheet discharge operation in step S16, the roll paper P not yet subjected to photographic printing has been pulled out from the roll paper cassette 18. If a next photographic printing is not performed continuously, the roll paper P not yet subjected to photographic printing is completely stored within the roll paper cassette 18, and must be in the standby state where the roll paper cassette 18 can be mountable and dismountable.

For this purpose, in step S17, it is necessary to reversely convey the roll paper P in a storage position, after the sheet discharging operation in step S16. In the middle of the reverse conveyance to the accommodating position in step S17, the leading edge of the roll paper P is separated from the roller pair consisting of the capstan roller 19 and the pinch roller 20, reversely to the sheet feeding operation in step S9, and can be conveyed only by the sheet feed roller 1.

Furthermore, the sheet feed roller 1 continues to be driven and rotated, so as to pull the roll paper P in the roll paper cassette 18, and reversely convey and stop the leading edge of the roll paper P to a position where it is sufficiently pulled in from the roll paper exit 18*b*.

In step S18, the cutter motor is driven, as a preparation of a separating operation of the sheet feed roller 1 in step S21, after the roll paper P has been completely pulled in the roll paper cassette 18. Finally in step S21, the separating operation of the sheet feed roller 1 is performed. During the photographic printing operation in step S11, the sheet feed roller 1 is always at the press-contacting position at which it comes into pressure contact with the roll paper P, and is in the conveyance state.

Thus, it is necessary to keep the standby state by separating the sheet feed roller 1 from the roll paper P, so that loading and draw-out of the roll paper cassette 18 are enabled, when a series of photographic printing operations are completed, or so that the roll paper P and the sheet feed roller 1 may not be deformed, even if they are left for a long period of time.

Here, as described above, the processing is advanced according to substantially reverse procedure from the press-contacting operation of the sheet feed roller 1 in step S5 and the cutter motor drive in step S6. First, in step S18, the cutter motor 7*a* is driven and rotated, and the movable cutter blade 7*c* is moved to the cutting position (lowermost point). During the course of the process, a regulation of coupling of the planet gear 6*b* and the gear 3*c* is released.

When the sheet feed motor 5 is driven and rotated clockwise, a rotational force is transmitted to the gear shaft unit 3, and thereby the cam gear 2, which meshes with the gear shaft unit 3, is driven and rotated. Furthermore, the sheet feed motor 5 is driven and rotated to turn the cam gear 2 to a position at which the sheet feed roller 1 moves to the retraction position. Thereby, the standby state is established.

In this way, a series of processing operations from the photographic printing start in step S1 to the photographic printing completion in step S22 are completed. At this time, as illustrated in FIG. 10A, the lock key shape 13*b* of the interlocking member 13 is released from the recessed portion 12*c* of the locking member 12, and the locking member 12 becomes movable to a range within which the cassette drawing-out operation can be performed.

During the period in which a trouble may occur, if the sheet cassette 18 is drawn out during the photographic printing operation as described above, the interlocking member 13 is configured to regulate a movement of the locking member 12. Consequently, a user's erroneous operation will not exert influence on the photographic printing operation.

With the configurations described above, such troubles that the sheet cassette is drawn out, and the position of the sheet cassette is shifted, due to the user's erroneous operation or an inadvertent accident during the photographic printing, can be surely prevented by a small-sized and inexpensive configuration Heretofore, the preferred exemplary embodiment of the present invention has been described, but the present invention is not limited to the exemplary embodiment, and various modifications and alterations within a range of the scope are possible. For example, the sheet feeding mechanism according to the exemplary embodiment is a mechanism for elevating the sheet feed roller, however, switching between pressing and retracting with respect to the sheet in the sheet feeding mechanism may be replaced by an elevating mechanism in which a sheet feeding pad is elevated, which conveys the sheet while sandwiching it between the sheet feed roller, which position is fixed, and the pad.

While the present invention has been described with reference to the exemplary embodiment, it is to be understood that the invention is not limited to the disclosed exemplary embodiment. The scope of the following claims is to be accorded the broadest interpretation so as to encompass all modifications, equivalent structures, and functions.

What is claimed is:

1. A sheet feeding apparatus capable of mounting a cassette in which a sheet is stored by allowing the cassette to be inserted in a cassette-loading direction into the sheet feeding apparatus, the sheet feeding apparatus comprising:

a sheet feeding mechanism configured to convey a sheet in a direction orthogonal to the cassette-loading direction of the sheet feeding apparatus, wherein the sheet feeding mechanism includes a sheet feed roller movable to a press-contacting position and a retraction position, an elevation cam operatively connected to the sheet feed roller to cause the sheet feed roller to move to the press-contacting position and to the retraction position, and a driving member operatively connected to the elevation cam to drive the elevation cam and operatively connectable to the sheet feed roller to drive the sheet feed roller;

a locking member movable to a locking position and to a release position, wherein the locking member is disposed to lock the cassette when the locking member is at the locking position so that the cassette cannot be drawn out of the sheet feeding apparatus, and the locking member is disposed to not lock the cassette when the locking member is in the release position so that the cassette can be drawn out of the sheet feeding apparatus;

an interlocking member operatively connected to the elevation cam such that the interlocking member moves with the sheet feed roller and the elevation cam, wherein the interlocking member is at a position at which it fixes the locking member at the locking position when the sheet feed roller is at the press-contacting position, and the interlocking member is at a position at which it does not fix the locking member at the locking position but allows the locking member to move to the release position when the sheet feed roller is at the retraction position;

a coupling unit movable between a coupling position, at which it transmits a drive of the driving member to the elevation cam, and a non-coupling position, at which it does not transmit the drive of the driving member to the elevation cam;

a switching unit movable between a first state and a second state; and a regulation unit movable upon movement of the switching unit to regulate a position of the coupling unit.

2. The sheet feeding apparatus according to claim 1, wherein, when the switching unit is in the first state, the regulation unit regulates the coupling unit to the non-coupling position, and, when the switching unit is in the second state, the regulation unit releases the regulation to the coupling unit.

3. The sheet feeding apparatus according to claim 1, wherein the switching unit is a cutting unit which is for cutting a sheet conveyed to a cutting position from the cassette, and the cutting unit moves to a non-cutting state in the first state, and the cutting unit moves to a cutting state in the second state.

4. The sheet feeding apparatus according to claim 1, wherein the sheet feed roller abuts against the elevation cam and the interlocking member abuts against the elevation cam, a first part of the elevation cam, against which the sheet feed roller abuts, being different from a second part of the elevation cam, against which the interlocking member abuts.

5. The sheet feeding apparatus according to claim 1, wherein the interlocking member has an engagement portion which releasably engages with the locking member while the sheet feed roller is located at the press-contacting position.

6. The sheet feeding apparatus according to claim 5, wherein between the engagement portion of the interlocking member and an engaged portion of the locking member, an amount of play is given before an engagement with the locking member for providing a range where the locking member is not separated from an abutment against the cassette.

7. The sheet feeding apparatus according to claim 1, further comprising:

an urging member configured to urge the cassette in a drawing-out direction thereof, wherein the locking member is arranged at a position opposed to the urging member.

8. The sheet feeding apparatus according to claim 1, wherein the elevation cam is rotated by a driving force transmitted from the driving member, and wherein, in a case where the elevation cam is driven to rotate, an abutment position, on the elevation cam, of the sheet feed roller against the elevation cam is changed to cause the sheet feed roller to move to the press-contacting position and to the retraction position.

* * * * *